US010400438B2

(12) United States Patent
Calderon Uriszar-Aldaca et al.

(10) Patent No.: US 10,400,438 B2
(45) Date of Patent: Sep. 3, 2019

(54) JOINING DEVICE FOR PRECAST REINFORCED CONCRETE COLUMNS WITH A DRY JOINT

(71) Applicant: FUNDACION TECNALIA RESEARCH & INNOVATION, San Sebastian-Guipuzcoa (ES)

(72) Inventors: Inigo Calderon Uriszar-Aldaca, San Sebastian-Guipuzcoa (ES); Amaia Aramburu Ibarlucea, San Sebastian-Guipuzcoa (ES); Jose Antonio Chica Paez, San Sebastian-Guipuzcoa (ES)

(73) Assignee: Fundacion Tecnalia Research & Innovation, San Sebastian (ES)

( * ) Notice: Subject to any disclaimer, the term of this patent is extended or adjusted under 35 U.S.C. 154(b) by 0 days.

(21) Appl. No.: 15/324,361

(22) PCT Filed: Jun. 25, 2015

(86) PCT No.: PCT/ES2015/070497
§ 371 (c)(1),
(2) Date: Jan. 6, 2017

(87) PCT Pub. No.: WO2016/005631
PCT Pub. Date: Jan. 14, 2016

(65) Prior Publication Data

US 2017/0183861 A1 Jun. 29, 2017

(30) Foreign Application Priority Data

Jul. 7, 2014 (EP) ..... 14382261

(51) Int. Cl.
*E04B 1/21* (2006.01)
*E04B 1/58* (2006.01)
(Continued)

(52) U.S. Cl.
CPC ..... *E04B 1/215* (2013.01); *E04B 1/5831* (2013.01); *E04C 3/22* (2013.01); *E04C 3/34* (2013.01);
(Continued)

(58) Field of Classification Search
CPC . E04H 9/025; E04C 3/34; E04C 5/165; E04C 3/22; E04B 2001/5887; E04B 1/5831
See application file for complete search history.

(56) References Cited

U.S. PATENT DOCUMENTS 2,724,261 A * 11/1955 Rensaa ..... E04B 1/0007 52/259
3,572,223 A * 3/1971 Vierregger ..... E01F 9/635 116/63 R
(Continued)

FOREIGN PATENT DOCUMENTS

AU 9229331 * 6/1993
CA 2045464 8/1990
(Continued)

OTHER PUBLICATIONS

International Search Report and Written Opinion dated Sep. 1, 2015 for PCT/ES2015/070497.

*Primary Examiner* — Babajide A Demuren
(74) *Attorney, Agent, or Firm* — Andrus Intellectual Property Law, LLP

(57) ABSTRACT

The joining device (100, 100') comprises a first cover (1) and a second cover (2), each of which has a plurality of through holes (3) that match up with one another in position, for the ends of the rebars of the columns (200, 200A) to pass through. The covers (1,2) are joined together by means of, at least, two transverse webs (4) and several stiffener reinforcements (5,5A), which are arranged in perpendicular to the covers (1,2). The device further comprises connecting
(Continued)

means (202, 203, 204, 205) between the ends of the rebars (201,201A) of the columns (200,200A).

12 Claims, 10 Drawing Sheets

(51) Int. Cl.

| | |
|---|---|
| ***E04C 3/22*** | (2006.01) |
| ***E04C 3/34*** | (2006.01) |
| ***E04C 5/16*** | (2006.01) |
| ***E04H 9/02*** | (2006.01) |
| *E04C 3/36* | (2006.01) |

(52) U.S. Cl.
CPC ..... *E04C 5/165* (2013.01); *E04H 9/025* (2013.01); *E04B 2001/5887* (2013.01); *E04C 3/36* (2013.01)

(56) References Cited

U.S. PATENT DOCUMENTS

| | | | | | |
|---|---|---|---|---|---|
| 3,745,731 | A * | 7/1973 | Simpson | E04B 1/20 | 52/236.4 |
| 3,785,097 | A * | 1/1974 | Seymour | E04G 21/14 | 52/126.7 |
| 4,009,550 | A * | 3/1977 | Young | E02D 5/523 | 249/93 |
| 4,099,360 | A * | 7/1978 | Outram | E02D 5/523 | 52/126.7 |
| 4,295,308 | A * | 10/1981 | Korfanta | E04H 12/2261 | 248/158 |
| 4,330,970 | A * | 5/1982 | Bonink | E04B 1/215 | 52/125.4 |
| 4,781,006 | A * | 11/1988 | Haynes | E04B 1/215 | 52/583.1 |
| 4,938,635 | A * | 7/1990 | Russell | E04B 1/215 | 403/337 |
| 5,669,196 | A * | 9/1997 | Dahl | E04C 5/163 | 403/173 |
| 9,057,170 | B2 * | 6/2015 | Tadros | E02D 5/523 | |
| 2008/0279620 | A1 * | 11/2008 | Berg | E04B 1/215 | 403/178 |
| 2009/0263189 | A9 * | 10/2009 | Koivunen | E02D 5/523 | 403/379.4 |
| 2010/0322717 | A1 * | 12/2010 | Paul | E02D 5/105 | 405/252 |
| 2013/0199123 | A1 * | 8/2013 | Junes | E04B 1/215 | 52/707 |

FOREIGN PATENT DOCUMENTS

| | | | | | |
|---|---|---|---|---|---|
| DE | 76 24 523 | | 9/1977 | | |
| DE | 3526449 | | 2/1987 | | |
| EP | 1857602 | | 11/2007 | | |
| EP | 1857602 | A2 * | 11/2007 | E04B 1/215 | |
| FR | 2367158 | | 5/1978 | | |
| FR | 2367158 | A1 * | 5/1978 | E04B 1/215 | |
| FR | 2417592 | | 9/1979 | | |
| FR | 2417592 | A1 * | 9/1979 | E02D 5/523 | |
| KR | 101 228 012 | | 2/2013 | | |
| WO | WO 9310314 | | 5/1993 | | |
| WO | WO 9310314 | A1 * | 5/1993 | E04B 1/215 | |
| WO | WO 2007074212 | | 7/2007 | | |
| WO | WO 2007074212 | A1 * | 7/2007 | E02D 5/226 | |
| WO | WO 2012/056101 | | 5/2012 | | |

* cited by examiner

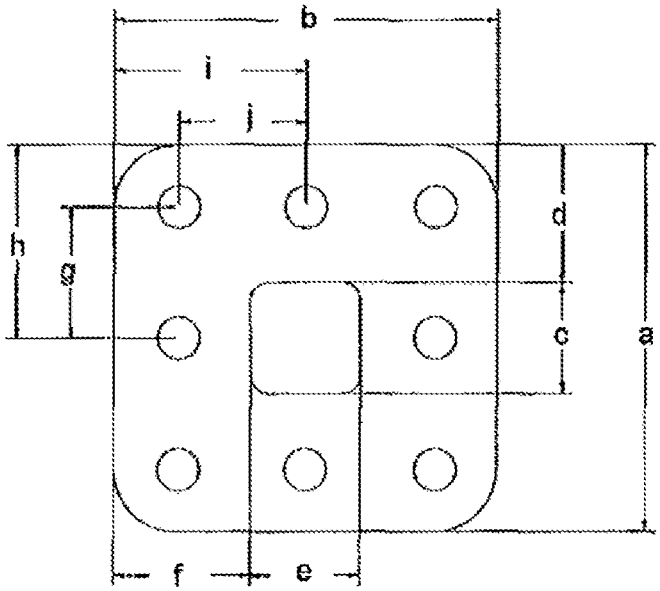
Fig.2a
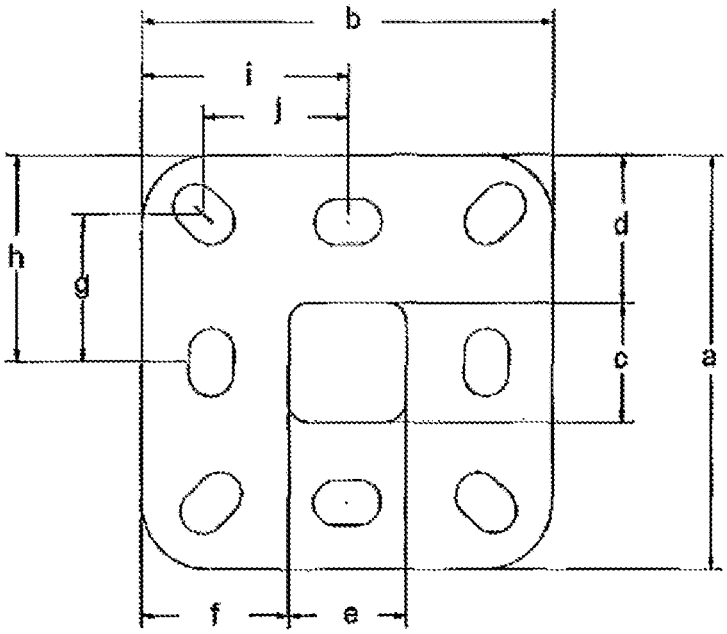
Fig.2b
Figure 2

JOINING DEVICE FOR PRECAST REINFORCED CONCRETE COLUMNS WITH A DRY JOINT

The object of the present invention is a junction between precast reinforced concrete columns with a dry joint, i.e. by means of a joint that does not require formwork prior to pouring fresh concrete, nor setting and form removal times, etc., which makes it possible to build high-rise buildings with a competitive edge, even in seismic risk areas. To this end, the present invention proposes a system that is open and universal, to adapt to the different possible geometries and cases, and has a joint that is dry and makes it easy to join together the different parts, ensuring stability, even with loads that are dynamic. The present document therefore describes a universal solution carried out in steel, which is adaptable, easy to implement, and durable.

STATE OF THE ART

The technical problem that the present invention solves is related to the joining together of precast reinforced concrete column elements and to building high-rise buildings, even in seismic risk areas, with an economically competitive edge. To build in such a way, an open and universal system is needed which may be adapted to the different possible geometries and cases in order to join together the different parts without having to wait for the concrete to set, and without the compulsory need for specialized guild works on site such as welders or formworkers, which end up making construction more expensive. To build high-rises in seismic risk areas, it is necessary to take into account not only weight and overloading, but also horizontal actions, wind and seism, in such a way that the joining means ensure stability even when faced with loads that are dynamic.

In the current State of the Art, various solutions have been put forth for column-column connections. Among them, one might point out the Korean document KR101260392, which defines junctions for precast columns and beams constituted by three basic elements: junctions between columns, called CLM, joining nodes, called HM, and beam junctions, called BLM.

The junctions between columns are divided into two, the so-called CLM, and the portion connecting consecutive column elements in the so-called HM.

On the one hand, the CLM junctions constitute two parallel plates with welded webs therebetween, forming a symmetrical piece. Said junctions are placed specifically at points in the column that are expected to have zero shear force. The rebars pass through the plates and are fixed by means of nuts on the other side. Lastly, in order to acquire its compression strength, it must be concreted in situ.

On the other hand, the force transmission in the part called HM takes place by means of either an in situ concrete core without a shear force transmitter, or by means of a profile embedded in a concrete core poured in situ. The column rebars in this section maintain continuity, but only at the corners, and may require more rebar on the sides of the column.

Therefore, the differences between this system and the one being proposed herein are as listed below:

In the first place, it does not solve the problem by means of a single system, but rather two systems that are clearly separate and identified as CLM and HM.

In the second place, it is not an open system, but rather requires specific precast elements, and therefore does not allow for operations to adapt it to the most commonly found types, since it requires embedded structural steel elements with set characteristics. On and beyond straight, prismatic elements, with set types of rebar.

In the third place, it is not a dry-joint system, as the junction always requires in situ concreting in order to be durable, which has a negative effect on the construction times of high-rise buildings, since it necessitates waiting through setting times and so forth.

In the fourth place, it is not an seism-resistant junction, as the junctions called CLM are intended to be located at points of the column with zero shear force, whereas zero shear force in two directions only matches up in very specific cases of buildings with double symmetry in their plan view and total regularity in terms of both their plan and elevation views. Moreover, the transmission of bending forces is inefficient, since the rebar forces are passed through the structural steel element, instead of connecting the rebars of both sides directly. In the HM junctions the continuous rebar is found only at the corners, which is insufficient in most cases. Lastly, the shearing and bending diagrams in beams and columns in for non-seismic actions are presented, verifying the lack of consideration.

Documents JP20080233079, JP5154962 and JP5160907 describe prefabricated column elements containing beam cantilevers. The element has holes that are reinforced with a steel spring, through which the rebar reinforcements of the front and rear column segments pass. The connection is made by simply fitting the elements together and fixing them with resins. This element does not, strictly speaking, define a connection between column elements, but rather a mixed precast column and beam solution that may be assembled with similar precast elements. Only permanent actions are studied to identify zero bending moment and zero shearing force points at which the connections are to be made, without taking into consideration the stress factors caused by possible seisms.

The three systems above are not, strictly speaking, systems for connecting precast columns, but rather are a closed system wherein the precast element is something else, and therefore are not open and able to be adapted, through small operations, to the most common existing precast elements. Furthermore, they are connected with resins, and thus are not disassemblable dry-joint systems. Lastly, they do not take seisms into account in their strategy or in their ways of connecting, only taking into account the fraction of actions that are permanent in nature.

Therefore, these systems require a high implementation investment, requiring formwork molds and proper specific pieces and elements for everything. These systems are not compatible with other precast systems, and it is not possible to apply them to a wide range of building geometries, nor do they ensure structural safety in seismic areas, thus limiting their applicability.

DESCRIPTION OF THE INVENTION

For the purpose of solving the technical problems indicated above, in a first aspect of the invention, the joining device between two precast reinforced concrete columns comprises a first cover (for example a cover on top when in assembled position) and a second cover (for example a cover on the bottom when in assembled position), parallel to one another, each of which has a plurality of through holes (distributed around the perimeter of the covers) that match up with one another in position, for the ends of the rebars of the columns to pass through. The covers are joined together by means of at least two transverse webs and several stiffener reinforcements, which are arranged in perpendicular to the covers (wherein joining will be carried out by joining together the elements of a single type, i.e. covers, webs or stiffeners, in parallel to one another and perpendicular to the rest; in other words, the webs and stiffeners are perpendicular to one another, and webs and stiffeners are in turn perpendicular to the covers, whereas the first cover is parallel to the second cover).

Once the joining device has been assembled, the second, bottom cover is supported upon the end of the existing column, while the end of the next column is supported upon the first, top cover of the device. In this way, the device of the invention supports the axial force of the columns. The device of the invention further comprises connecting means between the ends of the of both columns rebars, in order to transmit tensile forces between the two columns.

The invention is formed by joining the two webs to one of the covers so that the webs are held on two planes perpendicular to the plane of the cover and parallel to one another, aligned with two of the edges of the cover and equidistant from the center. To said webs, two inner stiffeners are joined, situated in the space between the webs, in perpendicular to both the webs and the cover, and joined to both webs and to the cover, situated on two parallel planes that are equidistant from the center thereof. On the other side of the webs and on the same plane as the inner stiffeners, outer stiffeners are joined to the webs and to the cover. Lastly, the second cover is situated in parallel to the first one, and in the same position, and is joined to the stiffeners to form a solution that is symmetrical with respect to the intermediate plane between the covers.

In a particular embodiment, the first cover and the second cover comprise, at least, one hole per corner and several (for example between one and three) holes situated between two corner holes, in such a way that all of the holes are at an equal distance from those adjacent to them (the holes are to be situated on the periphery of the covers in a position corresponding to the position of the column rebars).

In further particular embodiment, the holes are slotted.

In one embodiment, the first cover comprises a central opening that makes it possible to weld the webs and stiffeners from the inside during the building phase. Furthermore, once in service, the load will mainly pass through the sides of the opening, causing the concrete of the column to bulge, thus facilitating the work done by friction of the joining device. Obviously, it also reduces the amount of steel needed to manufacture the device.

In a further particular embodiment, the second cover further comprises a central opening, and between the central openings of the first cover and of the second cover, an open central space is defined which is filled with a structural filler material (for example concrete, mortar or resin), which provides a more robust core.

In a further particular embodiment, the connecting means are a coupling nut screwed onto threaded ends of the rebars of the columns. These connecting means may further comprise torque locknuts configured to pretension the coupling nut.

In a further particular embodiment, the connecting means are a joining element formed by two tubes joined to two bars forming a double-symmetric bifurcation, in such a way that the ends of the rebars of the columns pass through the inside of the tubes and are tightened with a nut on the other side, completing the junction.

In a further particular embodiment, the connecting means are a male-female junction comprising a threaded rod and a coupling nut into which said threaded rod is screwed (with the same thread pitch or a different one).

A further object of the invention is a process for manufacturing that comprises the steps of:

(i) obtaining a first cover and a second cover, each of which has a plurality of through holes;

(ii) welding at least two webs to the second cover by means of a fillet on one or both sides of the webs so that they are substantially perpendicular;

(iii) welding stiffener reinforcements to the webs and to the second cover so that they are substantially perpendicular to the webs and covers;

(iv) closing the assembly by welding the first top cover to the webs and stiffener reinforcements. To do so, first the first (top) cover is placed in position in order to subsequently weld the webs and the stiffener reinforcements to it from the outside, at least all of that which does not end up confined in the space between the webs and the inner stiffeners.

(v) In one embodiment, the first cover incorporates a central opening. In this case, taking advantage of the central opening, the joining of the device is completed by means of an inner welding fillet joining the webs and the stiffener reinforcements to the cover.

Lastly, an object of the invention is the use of the joining device whereby the joining device is placed upon the existing segment of column whose ends pass through the holes in the second (bottom) plate of the joining device. Subsequently, the connecting means are placed and, lastly, the next segment of column is put in place in such a way that it rests upon the joining device, the ends of the rebars of both segments of column thus ending up face-to-face with one another and passing through the holes in the first and second (top and bottom) cover of the joining device in such a way that the connecting means can join the two rebars together.

Therefore, the junction is intended to be implemented in the way as simple as possible, by means of the minimum number of pieces, repeating them by symmetry, which are joined to one another in such a way that, on site, they need only be placed at the specific height and joined together.

Throughout the description and the claims, the word "comprises" and variants thereof are not intended to exclude other technical characteristics, additions, components or steps. For those skilled in the art, other objects, advantages and characteristics of the invention may be deduced from both the description and the practical use of the invention. The following examples and drawings are provided by way of illustration, and are not meant to restrict the present invention. Furthermore, the present invention covers all of the possible combinations of particular and preferred embodiments indicated herein.

BRIEF DESCRIPTION OF THE DRAWINGS

What follows is a very brief description of a series of drawings which help to a better understanding of the invention, and which are expressly related to an embodiment of said invention that is presented by way of a non-limiting example of the same.

FIG. 2 Shows a plan detailing the maximum and minimum dimension that the joining device (100) of the present invention should have, in an embodiment with simple holes (FIG. 2*a*) and a second embodiment with slotted holes (FIG. 2*b*).

DESCRIPTION OF A DETAILED EMBODIMENT OF THE INVENTION

The attached figures show a particular exemplary embodiment of the invention. As has already been described, the joining device (100, 100') is intended to make joining together two precast reinforced concrete columns (200, 200A) as simple as possible, using a minimum amount of parts, repeating them by symmetry, in such a way that they are joined to one another by means of in-shop welding, so that on site it is only necessary to place them at the specific height and join together the rebars (201,201A) of the aforementioned segments of column (200,200A) through the joining device (100, 100').

Figure 1:
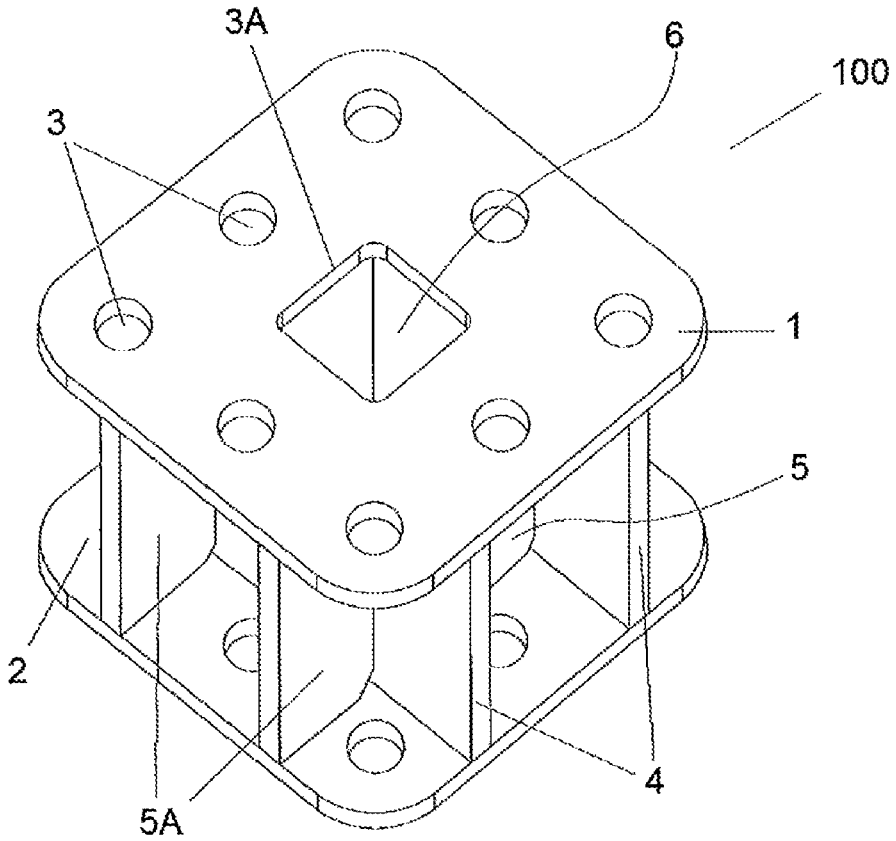
FIG. 1 Shows a view of the joining device (100) object of the present invention.
Figure 10:
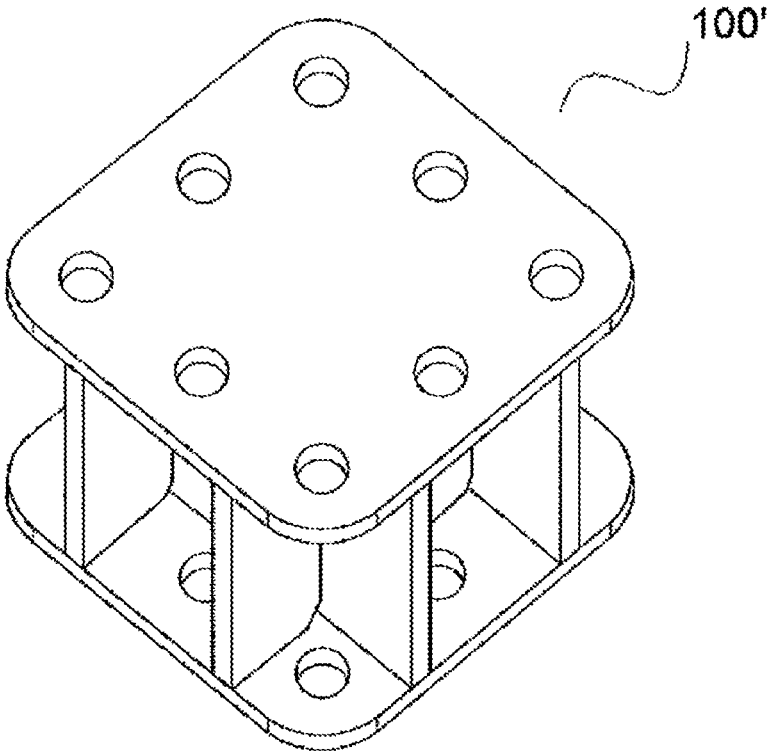
FIG. 10 Shows an embodiment of the joining device (100') without a central hole.

The figures show an exemplary embodiment of the joining device (100, 100') that is formed by an essentially prismatic or cubic body comprising a first, top cover (1) and a second, bottom cover (2), each of which has a plurality of through holes (3) distributed around the perimeter (1,2) that match up with one another in position. In an embodiment shown in FIG. 1, the first and second covers (1,2) of the joining device (100) comprise a central opening (3A) that defines an open central space. In an embodiment shown in FIG. 10, the covers (1,2) of the joining device (100') do not have a central opening. The covers (1,2) are joined together by means of, at least, two transverse webs (4) and several inner (5) and outer (5A) stiffener reinforcements, which are arranged in perpendicular to the transverse covers (4). In the embodiment of FIG. 1, the inner space (6) defined by the webs (4) and the inner stiffeners (5) matches up with the open central space (3A) of the covers (1,2), thus defining a space that passes through the assembly.

Likewise, in this particular embodiment, each through hole (3) is arranged in a quadrant delimited by the stiffener reinforcements (5,5A) and the webs (4). The joining device (100, 100') is especially intended for the purpose of connecting the rebars (201,201A) of the columns (200,200A), thus meaning that connecting means to this end will be necessary, which in this practical embodiment are a plurality of coupling nuts (202). For this purpose, the aforementioned rebars (201,201A) of the columns (200,200A) have threaded ends (threaded rods may also be welded onto the ends of the rebars).

The materials used in this exemplary embodiment of the joining device (100, 100') are steels with a characteristic yield stress of at least 275 MPa. The connecting means formed by screws, nuts or threaded rods are to be made of high-strength steel with a grade of 10.9 or higher.

Moreover, the distance from the outer edges at right angles to the holes (3) is normally to be comprised between 20 and 50 mm, although it may be greater. The diameter of said holes (3) is preferably comprised between 25 and 27 mm, although they may be in a greater range comprised between 13 and 35 mm.

Depending on each practical embodiment, the joining device (100, 100') comprises at least one hole (3) per corner and between one and three side holes, i.e. the holes (3) situated on the sides between two corner holes. All of the holes (3) are at an equal distance from those adjacent to them aligned along the same edge.

The open central space (3A) is designed to carry out the following functions:

- during the building phase, it makes it possible to weld the piece from the inside;
- it also makes it possible to fill the piece with a structural filler (concrete, mortar or resin), endowing it with a more robust core;
- in service, the load will mainly pass through its sides, causing the concrete of the column to bulge, thus facilitating the work done by friction;
- it reduces the steel consumed in making the piece.

The holes (3) situated along the edge may be slotted from their theoretical position in a direction perpendicular to the edge and towards it. A feature of this slotting is that if a horizontal force is present, causing a bending moment and shear force, the shear stress will only be resisted by means of friction and butting up against the compressed rebars due to the bending moment. Furthermore, if there is a pure bending force with a homogeneous cross-section (without fissures), the neutral fiber would pass through the middle zone and one half would be compressed; in this sense, said rebars would be exploited in order to transmit the shearing stresses that could exceed the friction.

The holes (3) situated at the corners have double slotting that is analogous to that of the holes (3) along the edges upon which they are located, in both directions, whose purpose it the same as that of the latter.

The use of slotted holes shall not always be necessary; in some instances the friction caused by the weight gravitating upon the column shall suffice, in which cases circular holes will be valid, with or without an increased radius. It will only be necessary at those points in the building having less weight gravitating upon them, in which case collaboration with the column may be necessary.

The total dimensions of the joining device (100, 100') are variable in order to adapt to a plurality of cases in terms of column (200,200A) geometry. Thus, the following table shows a non-limiting example with the illustrative maximum and minimum dimensions, which are variables of each element making up the joining device (100, 100') as detailed in FIG. 2. In cases in which segments of column (200,200A) with different cross-sections are connected, one must always consider the cross-section of the segment to be situated on top of the junction, which in general is smaller and therefore more constraining.

| Column cross-section | 15 mm-thick cover | Inner brace | Web |
|---|---|---|---|
| 300 × 300 mm | a = 300 mm<br>b = 300 mm<br>c = 85 mm<br>d = 107.5 mm | k = 115 mm | l = 300 mm |

-continued

| Column cross-section | 15 mm-thick cover | Inner brace | Web |
|---|---|---|---|
| | e = 85 mm<br>f = 107.5 mm<br>g = 100.5 mm<br>h = 150 mm<br>i = 150 mm<br>j = 100.5 mm | | |
| 300 × 400 mm | a = 400 mm<br>b = 300 mm<br>c = 135 mm<br>d = 132.5 mm<br>e = 85 mm<br>f = 107.5 mm<br>g = 150.5 mm<br>h = 200 mm<br>i = 150 mm<br>j = 100.5 mm | k = 115 mm | l = 400 mm |
| 300 × 500 mm | a = 500 mm<br>b = 300 mm<br>c = 185 mm<br>d = 157.5 mm<br>e = 85 mm<br>f = 107.5 mm<br>g = 200.5 mm<br>h = 250 mm<br>i = 150 mm<br>j = 100.5 mm | k = 115 mm | l = 500 mm |
| 400 × 400 mm | a = 400 mm<br>b = 400 mm<br>c = 135 mm<br>d = 132.5 mm<br>e = 135 mm<br>f = 132.5 mm<br>g = 150.5 mm<br>h = 200 mm<br>i = 200 mm<br>j = 150.5 mm | k = 215 mm | l = 500 mm |
| 400 × 500 mm | a = 500 mm<br>b = 400 mm<br>c = 185 mm<br>d = 157.5 mm<br>e = 135 mm<br>f = 132.5 mm<br>g = 200.5 mm<br>h = 250 mm<br>i = 200 mm<br>j = 150.5 mm | k = 215 mm | l = 500 mm |
| 500 × 500 mm | a = 500 mm<br>b = 500 mm<br>c = 185 mm<br>d = 157.5 mm<br>e = 185 mm<br>f = 157.5 mm<br>g = 200.5 mm<br>h = 250 mm<br>i = 250 mm<br>j = 200.5 mm | k = 315 mm | l = 500 mm |

In this particular embodiment, in order to connect the column (200,200A) rebars to the joining device (100, 100'), the ends of the rebars (201,201A) will be processed so that each end is threaded. To achieve this, in a particular embodiment high-strength 10.9 steel threaded rods are manually arc welded onto the end of the bars in the manner specified in standard UNE-EN ISO 17660-1:2006, through the specific arc welding method described in standard UNE-EN ISO 9692-1:2013. This has the advantage of being a transformation which may be carried out at very little cost, without requiring special equipment beyond what is needed to, for example, create the thread on the rebar itself, and with the simplest welding technique (manual arc). In another particular embodiment, threaded rebars are used straight away. In this way, the rebars (201,201A) end up face-to-face and a coupling nut (202) is used as a final joining element. Thus, said nut (202) is screwed all the way onto the lower segment of column (200), situated beneath the joining device (100, 100'). The upper segment of column (200A) is then placed upon the joining device (100, 100'), the rebars thus ending up face-to-face, unscrewing on one side while screwing in on the other with one single motion.

Figure 3:
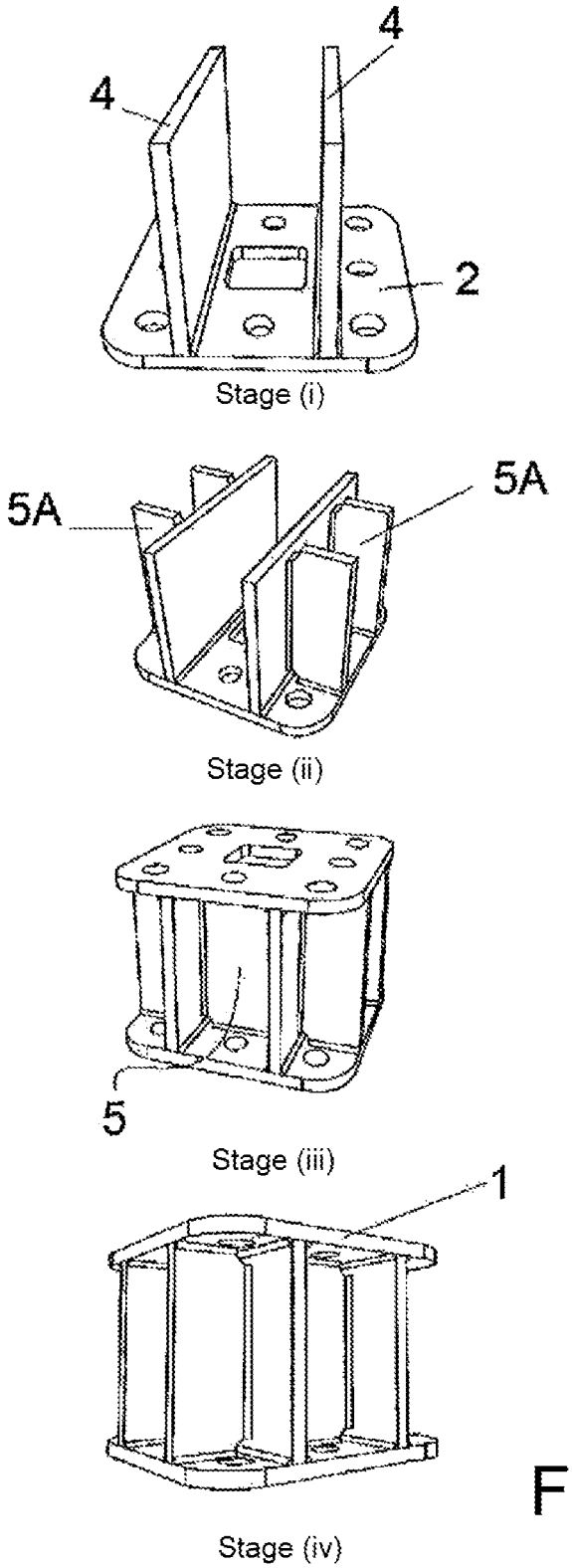
FIG. 3 Shows the various steps in the process of manufacturing (i)(ii)(iii)(iv) the joining device (100) shown in FIG. 1.

The sequence of the process of manufacturing the joining device (100, 100') is shown in FIG. 3, it being manufactured in a simple fashion, by means of fillet welding the elements making it up with 5 mm-throat fillets. Thus, first the two webs (4) are welded to the second, bottom cover (2) by means of a continuous fillet on both sides of the web (4), as shown is FIG. 3, step (i). Step (ii) shows the welding of the stiffener reinforcements, specifically the outer stiffeners (5A) that are welded to the webs (4) and to the second, bottom cover (2). Lastly, step (iii) shows how the inner stiffeners (5) are welded to the second, bottom cover (2), closing the assembly with step (iv) by welding the first, top cover (1), whereby first it is placed in position in order to subsequently weld to the webs and the stiffener reinforcements (5,5A), from the outside, at least all of that which does not end up confined in the space between the webs (4) and the inner stiffeners (5). Lastly, taking advantage of the holes (3) and, in the embodiment of FIG. 1, the open central space (3A), the inner fillet of the webs (4) and of the stiffener reinforcements (5,5A) is completed. The final appearance of the joining device (100, 100') is of course the one shown in FIGS. 1 and 10.

Figure 4:
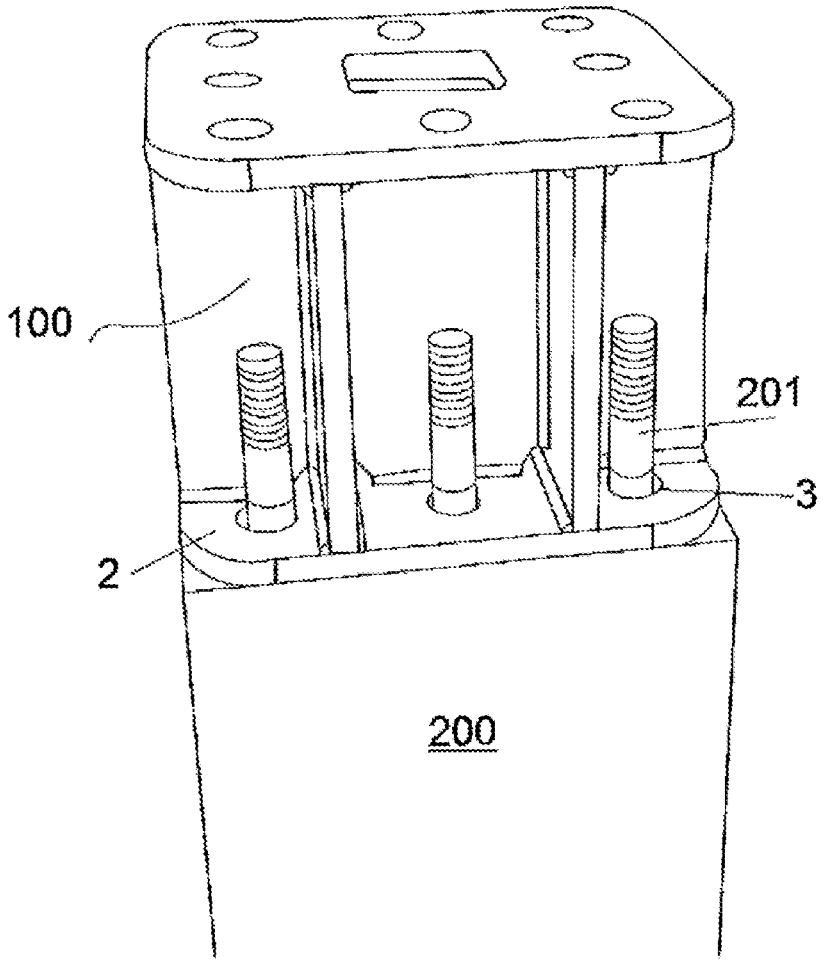
FIG. 4 Shows the placement of the joining device (100) of FIG. 1 upon a segment of column (200) situated below.
Figure 6:
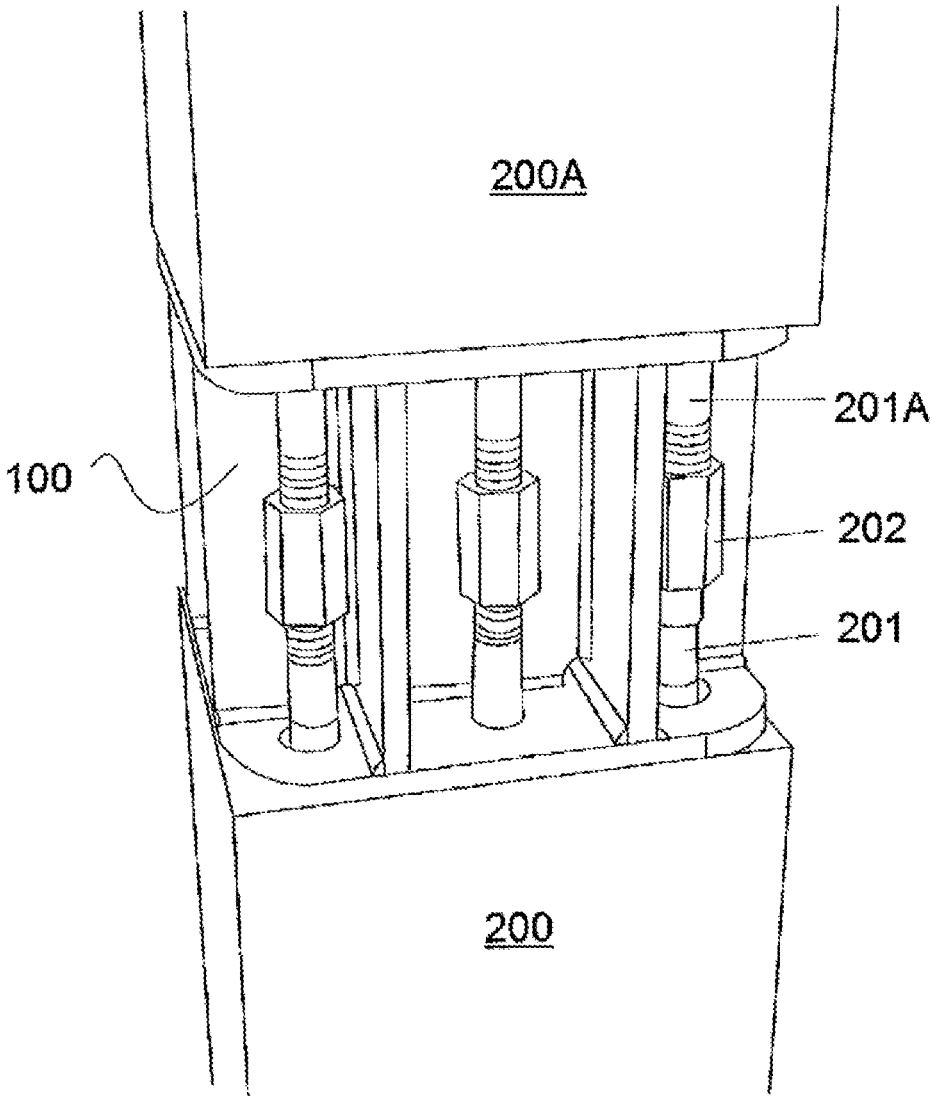
FIG. 6 Shows the joining device (100) between a lower segment of column (200) and an upper segment of column (200A) in use position.

The junction may be implemented very easily on site, as shown in FIGS. 4 and 6. In the first place, the joining device (100, 100') is placed upon the end section of an existing column (200) with the ends of the rebars (201) of the existing column (200) passing through the holes (3) in the second, bottom cover (2) of the joining device (100, 100'), as shown specifically in FIG. 4.

Figure 5:
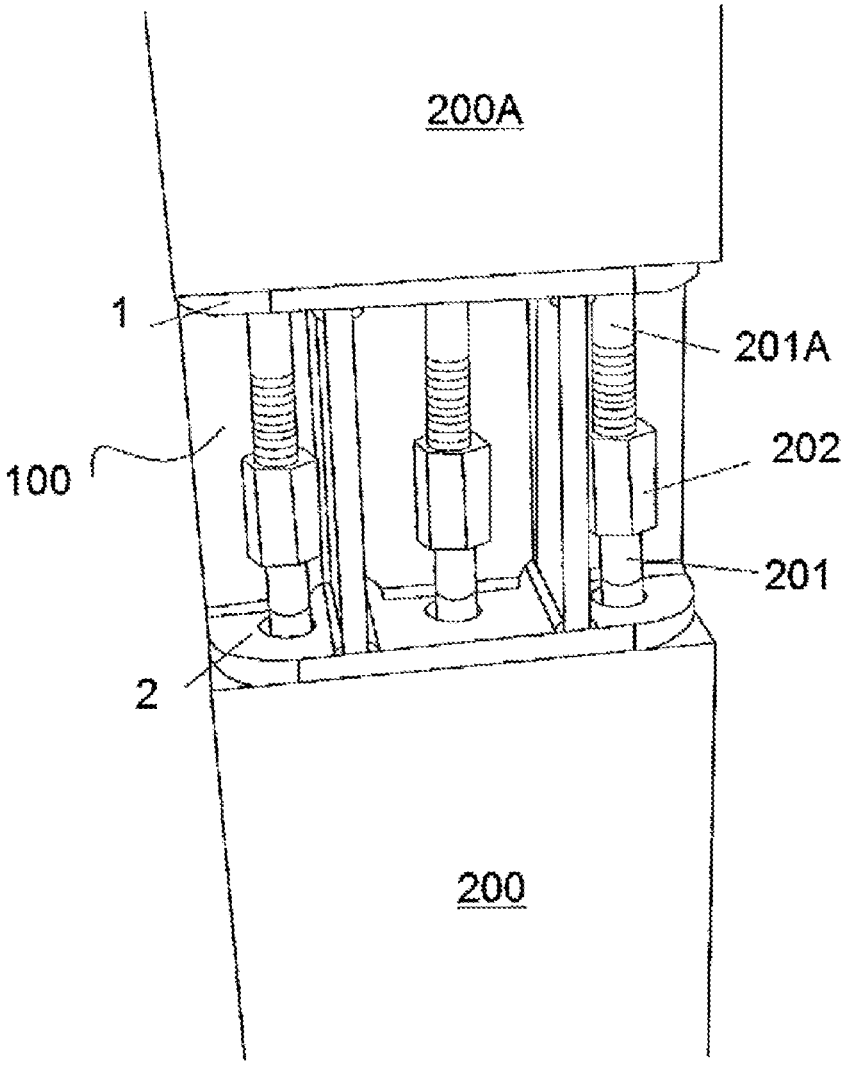
FIG. 5 Shows the connecting means, which in this embodiment are coupling nuts (202), screwed on all the way, and the upper segment of column (200A) being supported.

Subsequently, as shown in FIG. 5, the connecting means are placed, which in this particular embodiment are nuts (202) that are screwed all the way on, ensuring that there is space to support the next column (200A).

By forming the junction in this way, the end of the next column (200A) rests upon the joining device (100, 100'), the ends of the rebars (201A) of the next column (200A) ending up face-to-face with the rebars (201) of the existing column (200) by passing through the holes (3) in the first, top cover (1) of the joining device (100, 100'), the coupling nuts (202) then being able to join together the two rebars (201,201A), unscrewing from one and screwing onto the other. The junction is thus completed with a single motion, guaranteeing the transmission of tensile force between the rebars (201,201A) of each of the two sides, as shown in FIG. 6.

Figure 7:
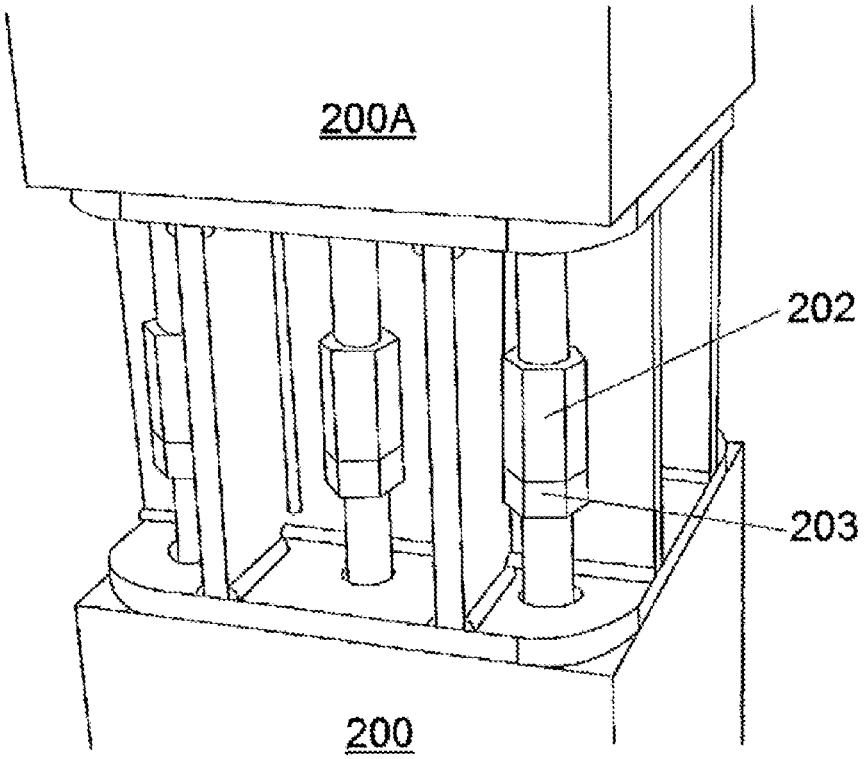
FIG. 7 Shows the joining device (100) wherein the connecting means incorporate a pretensioning element.

As has been indicated, the means of connecting in this particular embodiment shown in FIGS. 4 to 6 are embodied as a coupling nut (202). A pretensioning effect may be achieved by following the process shown in said figures wherein first of all the joining device (100, 100') is placed on the springing point of the lower column (200). The next step consists of adding torque nuts (203) and screwing them all the way on; upon arriving at this point they are pretensioned. Once it has been pretensioned, the coupling nut (202) is added and screwed on. Then, the springing point of the top column (200A) is placed upon the device (100, 100'), and the coupling nut (202) is unscrewed, thus screwing it onto the next segment of rebar. Once the connection has been made, the torque nut (203) is loosened, transmitting the stress to the top connection, and is unscrewed until it is pressed against the coupling nut (202), acting as a locknut, as shown in FIG. 7. The effect may be increased even more with another nut in the upper segment of rebar, loosening it as well and doubling the pretensioning effect.

Figure 8:
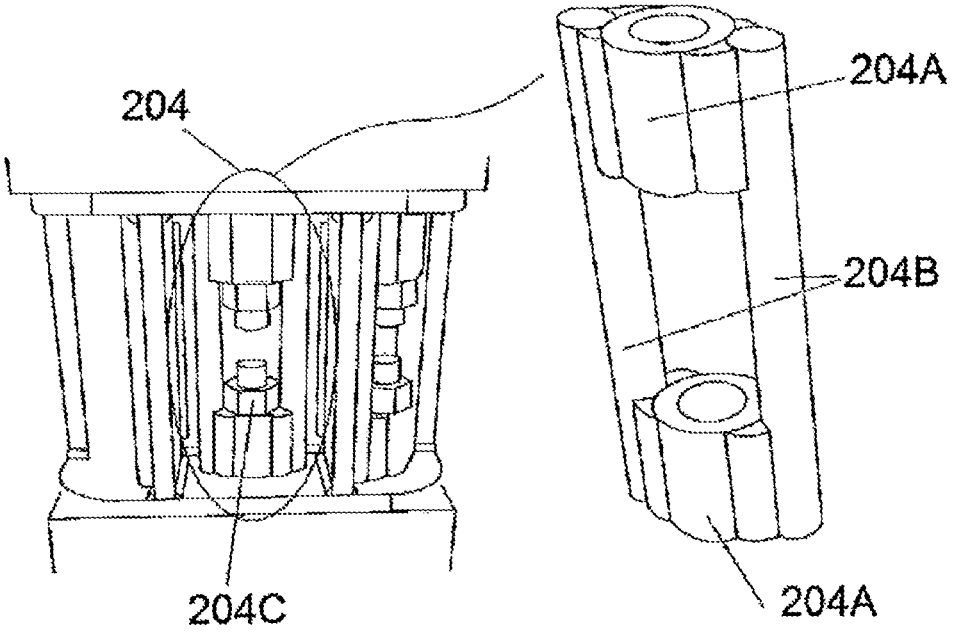
FIG. 8 Shows a second embodiment of the connecting means of the joining device (100).

FIG. 8 shows a second embodiment of the connecting means. This second embodiment is intended not to transmit compressive stress, beyond prior preloading and pretensioning, and to avoid problems of tolerances, threads meeting, and so on. It is a joining element (204) formed by two structural steel tubes (204A) welded to two concrete-reinforcing corrugated steel bars (204B), forming a doubly-symmetrical bifurcation. The ends of the column rebars of consecutive segments (200,200A) pass through the inside of the tubes (204A) and are tightened with a nut (204C) on the other side, completing the junction. When the rebars are subjected to tensile forces, they pass the pull of the threaded end of the rebar (201) to the nut (204C), from the latter to the joining element (204), and from there to the opposite nut (204C) and opposite rebar (201A). If the rebars are compressed, they do not pass on this compression since the nut does not transmit forces, or at least not beyond the effect of loosening if it was deliberately pretensioned beforehand. Thus, this embodiment of the junction is simple: first the column is placed and afterwards the piece with the necessary connecting elements, after which the nut of the lower segment is put on, closing it, and then the upper segment is placed, the nut is placed, and the junction is thus completed.

Figure 9:
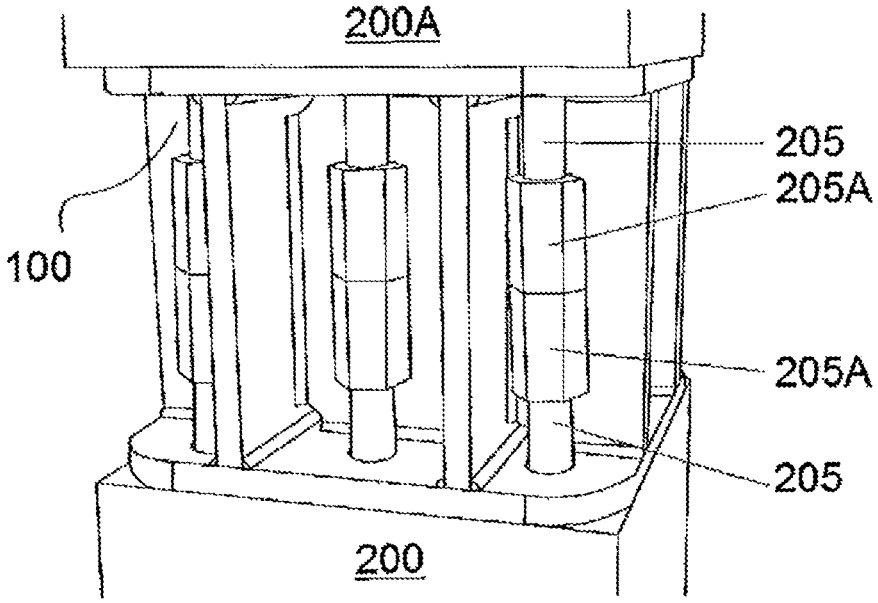
FIG. 9 Shows a third embodiment of the connecting means of the joining device (100).

FIG. 9 shows a third embodiment of the connecting means. The form of the male-female junction consists of a threaded rod (205) and a coupling nut (205A) into which it is screwed. It has the advantage of making it possible to progressively bring them closer together, and there is an increase in tolerance that makes it easier for the top and bottom screws to meet, where it is possible for the position of the beginning of the threads to not match up and require a bit more play. Assembly is carried out by first placing the joining device (100) and the coupling nuts (205A), and then screwing the threaded rod (205) into the left over section of the nut (205A), and unscrewing the coupling nut (205A) until the end section of threaded rod meets the opposing coupling nut (205A), and both screws (205A) are screwed on and tightened, completing the junction.

The invention claimed is:

1. A joining device between two precast reinforced concrete columns, the concrete columns comprising rebars embedded therein, characterized in that it comprises a first cover and a second cover, parallel to one another, each of which has a plurality of through holes that match up with one another in position, for the ends of the rebars of the columns to pass through, and wherein the covers are joined together by means of, at least, two transverse webs and several stiffener reinforcements, which are arranged in perpendicular to the covers, the device comprising connecting means between the ends of the rebars of the columns;

wherein the first cover comprises a central opening and the second cover comprises a central opening and between the central openings of the first cover and of the second cover an open central space is defined which is filled with a structural filler material.

2. Joining device according to claim 1, wherein the top cover and the bottom cover comprise at least one hole per corner and several holes situated between two corner holes, in such a way that all of the holes are at an equal distance from those adjacent to them.

3. Joining device according to claim 1, wherein the holes are slotted.

4. Joining device according to claim 1, wherein the connecting means are a coupling nut that can screw onto threaded ends of the rebars of the columns.

5. Joining device according to claim 4, comprising torque nuts configured to pretension the coupling nut.

6. Joining device according to claim 1, wherein the connecting means are a joining element formed by two tubes welded to two bars forming a double-symmetric bifurcation, in such a way that the ends of the rebars of the columns pass through the inside of the tubes and are tightened with a nut on the other side, completing the junction.

7. Joining device according to claim 1, wherein the connecting means are a male-female junction comprising a threaded rod and a coupling nut into which it is screwed.

8. Joining device according to claim 1, wherein the connecting means are welds.

9. A process for manufacturing a joining device, characterized in that it comprises the steps of:

obtaining a first cover and a second cover, each of which has a plurality of through holes such that the through holes match up along a direction perpendicular to the first cover and the second cover when the first cover and the second cover face each other;

welding at least two webs to the second cover by means of a continuous fillet on both sides of the webs so that they are substantially perpendicular therebetween and to the covers;

welding stiffener reinforcements to the webs and to the second cover so that they are substantially perpendicular to the webs and covers; and closing the assembly by welding the first top cover to the webs and stiffener reinforcements.

10. A joining device between two precast reinforced concrete columns, the concrete columns comprising rebars embedded therein, characterized in that it comprises a first cover and a second cover, parallel to one another, each of which has a plurality of through holes that match up with one another in position, for the ends of the rebars of the columns to pass through, and wherein the covers are joined together by means of, at least, two transverse webs and several stiffener reinforcements, which are arranged in perpendicular to the covers, the device comprising connecting means between the ends of the rebars of the columns;

wherein the connecting means are a joining element formed by two tubes welded to two bars forming a double-symmetric bifurcation, in such a way that the ends of the rebars of the columns pass through the inside of the tubes and are tightened with a nut on the other side, completing the junction.

11. A joining device between two precast reinforced concrete columns, the concrete columns comprising rebars embedded therein, characterized in that it comprises a first cover and a second cover, parallel to one another, each of which has a plurality of through holes that match up with one another in position, for the ends of the rebars of the columns to pass through, and wherein the covers are joined together by means of, at least, two transverse webs and several stiffener reinforcements, which are arranged in perpendicular to the covers, the device comprising connecting means between the ends of the rebars of the columns;

wherein the connecting means are a male-female junction comprising a threaded rod and a coupling nut into which it is screwed.

12. A joining device between two precast reinforced concrete columns, the concrete columns comprising rebars embedded therein, characterized in that it comprises a first cover and a second cover, parallel to one another, each of which has a plurality of through holes that match up with one another in position, for the ends of the rebars of the columns to pass through, and wherein the covers are joined together by means of, at least, two transverse webs and several stiffener reinforcements, which are arranged in perpendicular to the covers, the device comprising welds between the ends of the rebars of the columns.

* * * * *